US007974848B2

(12) United States Patent
Kim et al.

(10) Patent No.: US 7,974,848 B2
(45) Date of Patent: Jul. 5, 2011

(54) METHOD AND APPARATUS FOR ENCODING AUDIO DATA

(75) Inventors: Mi-young Kim, Suwon-Si (KR); Si-hwa Lee, Seoul (KR); Do-hyung Kim, Hwaseong-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 989 days.

(21) Appl. No.: 11/766,499

(22) Filed: Jun. 21, 2007

(65) Prior Publication Data

US 2007/0299662 A1 Dec. 27, 2007

(30) Foreign Application Priority Data

Jun. 21, 2006 (KR) ..... 10-2006-0056072
Jun. 21, 2007 (KR) ..... 10-2007-0060997

(51) Int. Cl.
*G10L 19/00* (2006.01)

(52) U.S. Cl. ..... 704/500; 704/230
(58) Field of Classification Search ..... 704/500–504, 704/222, 230
See application file for complete search history.

(56) References Cited

U.S. PATENT DOCUMENTS

2003/0088423 A1* 5/2003 Nishio et al. ..... 704/500
* cited by examiner

*Primary Examiner* — Abul Azad
(74) *Attorney, Agent, or Firm* — Staas & Halsey LLP

(57) ABSTRACT

Provided are an audio data encoding method and apparatus including determining an initial scale factor value for each frequency band of the audio data according to a quantization error and a maximum permissible distortion level for each frequency band; comparing the initial scale factor value for each frequency band and a predetermined common scale factor value and determining a final scale factor value for each frequency band based on a comparison result; quantizing the audio data using the final scale factor value for each frequency band; and encoding the quantized audio data.

16 Claims, 3 Drawing Sheets

METHOD AND APPARATUS FOR ENCODING AUDIO DATA

CROSS-REFERENCE TO RELATED PATENT APPLICATION

This application claims the benefit of Korean Patent Application Nos. 10-2006-0056072, filed on Jun. 21, 2006, and 10-2007-0060997, filed on Jun. 21, 2007 in the Korean Intellectual Property Office, the disclosure of which is incorporated herein in its entirety by reference.

BACKGROUND OF THE INVENTION

1. Field of the Invention

The present invention relates to compression of audio data, and more particularly, to an audio data encoding method and apparatus capable of bit rate control.

2. Description of the Related Art

An audio data encoding process comprises a transformation operation of transforming time-domain audio data into frequency-domain audio data, a calculation operation of calculating a maximum permissible distortion level for each frequency band by reflecting human hearing properties, a quantization operation of quantizing the frequency-domain audio data according to the maximum permissible distortion level for each frequency band, and a coding operation of loselessly encoding the quantized frequency-domain audio data.

Meanwhile, the quantization operation occupies most of the time taken to perform the audio data encoding process. Therefore, a method of more quickly completing the quantization operation is needed in order to more quickly complete the encoding of audio data.

SUMMARY OF THE INVENTION

The present invention provides an audio data encoding method capable of more quickly completing the encoding of audio data, and more particularly, capable of more quickly completing the quantization of audio data.

The present invention also provides an audio data encoding apparatus capable of more quickly completing the encoding of audio data, and more particularly, capable of more quickly completing the quantization of audio data.

The present invention also provides a computer readable recording medium storing a program for executing an audio data encoding method capable of more quickly completing the encoding of audio data, and more particularly, capable of more quickly completing the quantization of audio data.

According to an aspect of the present invention, there is provided an audio encoding method comprising: determining an initial scale factor value for each frequency band of the audio data according to a quantization error and a maximum permissible distortion level for each frequency band, comparing the initial scale factor value for each frequency band and a predetermined common scale factor value and determining a final scale factor value for each frequency band based on a comparison result; quantizing the audio data using the final scale factor value for each frequency band, and encoding the quantized audio data.

According to another aspect of the present invention, there is provided an audio data encoding apparatus comprising: a first scale factor determiner determining an initial scale factor value for each frequency band of the audio data according to a quantization error and a maximum permissible distortion level for each frequency band; a second scale factor determiner comparing the initial scale factor value for each frequency band and a predetermined common scale factor value and determining a final scale factor value for each frequency band based on a comparison result; a quantizer quantizing the audio data using the final scale factor value for each frequency band; and a lossless encoding unit encoding the quantized audio data.

According to another aspect of the present invention, there is provided a computer readable recording medium storing a program for executing a method comprising: determining an initial scale factor value for each frequency band of the audio data according to a quantization error and a maximum permissible distortion level for each frequency band; comparing the initial scale factor value for each frequency band and a predetermined common scale factor value and determining a final scale factor value for each frequency band based on a comparison result; quantizing the audio data using the final scale factor value for each frequency band; and encoding the quantized audio data.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

The attached drawings for illustrating preferred embodiments of the present invention are referred to in order to gain a sufficient understanding of the present invention, the merits thereof, and the objectives accomplished by the implementation of the present invention.

Hereinafter, the present invention will be described more fully with reference to the accompanying drawings, in which exemplary embodiments of the invention are shown.

Figure 1:
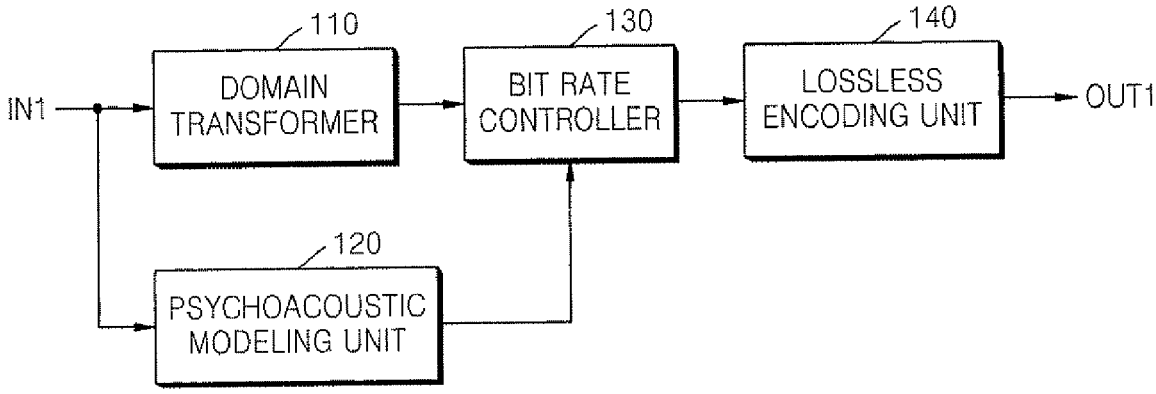
FIG. 1 is a block diagram of an audio data encoding apparatus according to an embodiment of the present invention.

FIG. 1 is a block diagram of an audio data encoding apparatus according to an embodiment of the present invention. Referring to FIG. 1, the audio data encoding apparatus comprises a domain transformer 110, a psychoacoustic modeling unit 120, a bit rate controller 130, and a lossless encoding unit 140.

The domain transformer 110 transforms time-domain audio data (pulse code modulation (PCM) data), which is input through an input terminal IN1, into frequency-domain audio data. To this end, the domain transformer 110 can perform modified discrete cosine transformation (MDCT) with regard to the time-domain audio data that is input through the input terminal IN1.

Meanwhile, human hearing levels are generally different for each frequency band of audio data. Thus, audio data that is quantized while permitting a distortion that is beyond the range of human hearing for each frequency band of the audio data has a lower encoding bit rate than that of audio data that is quantized while prohibiting a distortion that is beyond the range of human hearing for each frequency band of the audio data.

The psychoacoustic modeling unit 120 transforms the time-domain audio data that is input through the input terminal IN1 into the frequency-domain audio data, and calculates a maximum permissible distortion level of the frequency-domain audio data for each frequency band of the audio data based on human hearing properties. The maximum permissible distortion level is the maximum distortion level beyond the range of human hearing.

The bit rate controller 130 quantizes the audio data that is input from the domain transformer 110. In order to quantize data, it is necessary to determine spaces (what is called, "quantization step size") between the data to be quantized.

The bit rate controller 130 determines a scale factor value for each frequency band of the audio data and then quantizes the audio data. In the present specification, the scale factor value for each frequency band indicates the quantization step size and each of these scale factor values differs from each other.

In more detail, the bit rate controller 130 can determine the scale factor value for each frequency band of the audio data as a value used to quantize the audio data according to a permissible distortion level of the audio data that is not larger than the maximum permissible distortion level for each frequency band of the audio data. The maximum permissible distortion level, as described above, is calculated in the psychoacoustic modeling unit 120. Thereafter, the bit rate controller 130 can adjust the value for each frequency band of the audio data as a value used to quantize the audio data ensuring that a used bits, that is, the number of bits necessary to encode the audio data, is not larger than a maximum target bits. The maximum target bits is the maximum number of bits that are to be used to encode the audio data. Thereafter, the bit rate controller 130 can quantize the audio data using the scale factor value for each frequency band of the audio data. Therefore, the audio data encoded according to the present invention can have the bit rate equal to or less than the predetermined target bit rate in any case.

The lossless encoding unit 140 performs lossless coding with regard to the "quantized audio data" that is input from the bit rate controller 130, and outputs the losslessly encoded audio data through an output terminal OUT1. For example, the lossless encoding unit 140 can perform entropy coding with regard to the "quantized audio data".

Figure 2:
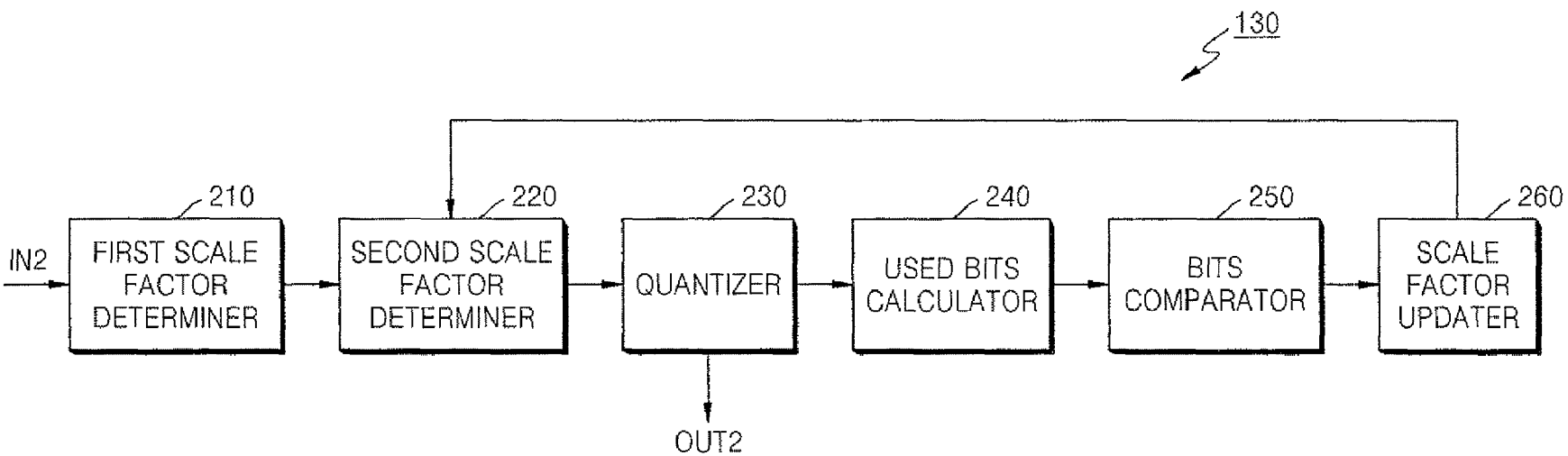
FIG. 2 is a block diagram of a bit rate determiner illustrated in FIG. 1 according to an embodiment of the present invention.

FIG. 2 is a block diagram of the bit rate controller 130 illustrated in FIG. 1 according to an embodiment of the present invention. Referring to FIG. 2, the bit rate controller 130 comprises a first scale factor determiner 210, a second scale factor determiner 220, a quantizer 230, a used bits calculator 240, a bits comparator 250, and a scale factor updater 260.

The first scale factor determiner 210 determines an initial scale factor value for each frequency band of audio data that is input through an input terminal IN2 according to a quantization error for each frequency band and a maximum permissible distortion level. The audio data that is input through the input terminal IN2 is input from the domain transformer 110.

In more detail, the first scale factor determiner 210 determines an initial scale factor value for a frequency band of the audio data according to the "quantization error" and the "maximum permissible distortion level" for the frequency band. The "quantization error" for the frequency band is a distortion level of the audio data for the frequency band when the audio data is quantized. The first scale factor determiner 210 can calculate a value of the "quantization error" after the audio data is quantized, or estimate the value of the "quantization error" assuming that the audio data is quantized. The "maximum permissible distortion level" for the frequency band, as mentioned above, is calculated in the psychoacoustic modeling unit 120.

In more detail, the first scale factor determiner 210 can determine a maximum scale factor value for the frequency band as the initial scale factor value for the frequency band, ensuring that the "quantization error" for the frequency band is not larger than the "maximum permissible distortion level" for the frequency band.

In order to determine the initial scale factor value for the frequency band as described above, the first scale factor determiner 210 determines whether the "quantization error" for the frequency band is larger than the "maximum permissible distortion level" for the frequency band according to all possible scale factor values for each frequency band, and selects a maximum scale factor value from among possible scale factor values satisfying the requirement that the "quantization error" for the frequency band is not larger than the "maximum permissible distortion level" for the frequency band.

The first scale factor determiner 210 can adjust a default value for a frequency band of the audio data according to a "quantization error according to a scale factor default value for the frequency band" and a "maximum permissible distortion level for the frequency band", and determine the adjusted default value as an "initial scale factor value for the frequency band". In this case, the greater a difference between the "quantization error according to the scale factor default value for the frequency band" and the "maximum permissible distortion level for the frequency band" becomes, the greater a difference between the "scale factor default value for the frequency band" and the "initial scale factor value for the frequency band".

The second scale factor determiner 220 compares the "initial scale factor value determined by the first scale factor determiner 210 for each frequency band" and a "predetermined common scale factor value" for each frequency band of the audio data that is input through the input terminal IN2, and determines a final scale factor value for each frequency band based on the comparison result. The common scale factor value is a set scale factor value for each band, provided that each frequency band of the audio data has the same scale factor value.

In more detail, the second scale factor determiner 220 can determine a value that is not larger between an "initial scale factor value for a frequency band of the audio data" and a "predetermined common scale factor value of the audio data" as a "final scale factor value for the frequency band".

That is, if the initial scale factor value for a frequency band is larger than the predetermined common scale factor value, the second scale factor determiner 220 determines the predetermined common scale factor value as the final scale factor value for the frequency band. If the initial scale factor value for a frequency band is smaller than the predetermined common scale factor value, the second scale factor determiner 220 determines the initial scale factor value for the frequency band as the final scale factor value for the frequency band. However, if the initial scale factor value for a frequency band is the same as the predetermined common scale factor value, the second scale factor determiner 220 determines the initial scale factor value for the frequency band or the predetermined common scale factor value as the final scale factor value for the frequency band.

The operation of the first and second scale factor determiners 210 and 220 is for determining a scale factor value for each frequency band of the audio data as a value used to quantize the audio data by the bit rate controller 130 ensuring that a permissible distortion level for each frequency band of the audio data is not larger than a maximum permissible distortion level for each frequency band of the audio data.

As described above, by merely comparing an initial scale factor value for a frequency band and a predetermined common scale factor value, the second scale factor determiner 220 can determine a scale factor value for the frequency band for quantizing audio data of the frequency band, ensuring that a permissible distortion level of the audio data for each frequency band is not larger than a maximum permissible distortion level of the audio data for each frequency band. That is, the second scale factor determiner 220 can quickly determine a final scale factor value of the audio data for each frequency band.

The quantizer 230 quantizes the audio data that is input through the input terminal IN2 considering the final scale factor values of the audio data for all frequency bands.

The used bits calculator 240 calculates a used bits of the audio data that is input through the input terminal IN2, which is the number of bits necessary to encode the audio data, considering the quantized audio data that is input from the quantizer 230.

The bits comparator 250 compares the used bits that is calculated by the used bits calculator 240 and a "predetermined maximum target bits". In more detail, the bits comparator 250 determines whether the used bits is larger than the predetermined maximum target bits.

If the used bits is larger than the predetermined maximum target bits, the bits comparator 250 instructs the scale factor updater 260 to operate. In this case, the scale factor updater 260 updates a common scale factor value. In more detail, the scale factor updater 260 increases the common scale factor value to a specific value. Thereafter, the scale factor updater 260 generates a control signal and outputs the control signal to the second scale factor determiner 220. In this case, the second scale factor determiner 220 reoperates by operating in response to the control signal.

On the other hand, if the used bits is not larger than the predetermined maximum target bits, the quantizer 230 outputs the audio data that is most recently quantized to the lossless encoding unit 140 through an output terminal OUT2.

The operation of the used bits calculator 240, the bits comparator 250, and the scale factor updater 260 is to adjust a "scale factor value for each frequency band of audio data", which is determined to quantize the audio data ensuring that a permissible distortion level for each frequency band of the audio data is not larger than a maximum permissible distortion level for each frequency band of the audio data, as a value used to quantize the audio data by the bit rate controller 130, ensuring that a used bits of the audio data is not larger than a maximum target bits of the audio data.

Figure 3:
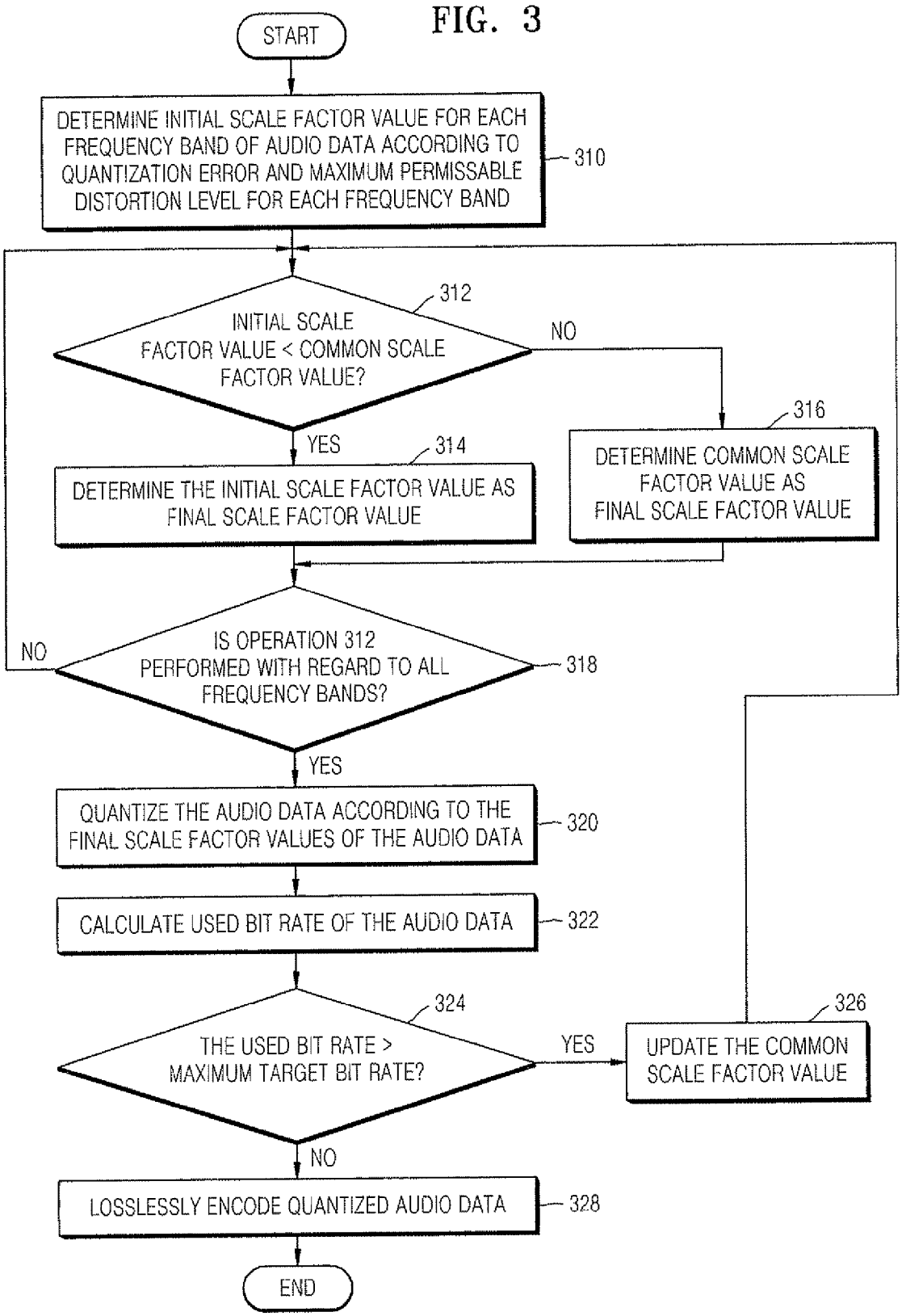
FIG. 3 is a flowchart of an audio data encoding method according to an embodiment of the present invention.

FIG. 3 is a flowchart of an audio data encoding method according to an embodiment of the present invention. Referring to FIG. 3, the audio data encoding method comprises operations 310 through 324 of quantizing the audio data, ensuring that a permissible distortion level for each frequency band of the audio data is not larger than a maximum permissible distortion level for each frequency band of the audio data and that a used bits of the audio data is not larger than a maximum target bits of the audio data, and an operation 326 of losslessly encoding the quantized audio data.

The first scale factor determiner 210 determines an initial scale factor value for each frequency band of the audio data according to a "quantization error" and "maximum permissible distortion level" for each frequency band (Operation 310).

The second scale factor determiner 220 determines whether the initial scale factor value is smaller than a common scale factor value with regard to the audio data of a frequency band (Operation 312).

If it is determined that the initial scale factor value is smaller than the common scale factor value with regard to the audio data of the frequency band, the second scale factor determiner 220 determines the initial scale factor value as a final scale factor value of the audio data for the frequency band (Operation 314).

On the other hand, if it is determined that the initial scale factor value is not smaller than the common scale factor value with regard to the audio data of the frequency band, the second scale factor determiner 220 determines the common scale factor value as a final scale factor value of the audio data for the frequency band (Operation 316).

After the second scale factor determiner 220 proceeds with Operation 314 or 316, the second scale factor determiner 220 determines whether Operation 312 has been performed with regard to all frequency bands (Operation 318).

If it is determined that there is a frequency band for which Operation 312 has not been performed, the second scale factor determiner 220 proceeds with Operation 312 to perform Operations 312 and 314 or Operations 312 and 316 with regard to the frequency band for which Operation 312 has not been performed.

On the other hand, if it is determined that there is no frequency band for which Operation 312 has not been performed, the quantizer 230 quantizes the audio data considering the final scale factor values of the audio data for all frequency bands (Operation 320).

After performing Operation 320, the used bits calculator 240 calculates a used bits of the audio data, which is the number of bits necessary to encode the audio data, considering the audio data that is most recently quantized in Operation 320 (Operation 322).

After performing Operation 322, the bits comparator 250 determines whether the used bits calculated in Operation 322 is larger than a maximum target bits (Operation 324).

If it is determined that the used bits calculated in Operation 322 is larger than the maximum target bits, the scale factor updater 260 updates the common scale factor value and proceeds with Operation 312 (Operation 326).

On the other hand, if it is determined that the used bits calculated in Operation 322 is not larger than the maximum target bits, the lossless encoding unit 140 losslessly encodes the audio data that is most recently quantized in Operation 320 (Operation 328).

The invention can also be embodied as computer readable codes on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, and carrier waves (such as data transmission through the Internet).

The audio data encoding method and apparatus according to the present invention can determine a scale factor value of the audio data for each frequency band to quantize the audio data, by merely comparing an initial scale factor value of the audio data for each frequency band and a predetermined common scale factor value, ensuring that a permissible distortion level of the audio data for each frequency band is not larger than a maximum permissible distortion level of the audio data for each frequency band, thereby quickly determining a final scale factor value of the audio data for each frequency band. Therefore, the audio data encoding method and apparatus according to the present invention can more quickly complete the encoding of the audio data, and in particular, can more quickly complete the quantization of the audio data.

The conventional audio data encoding apparatus determines a scale factor value of audio data for each frequency band as a value used to quantize the audio data, provided that the scale factor value of the audio data for each frequency band is identical to each other, ensuring that a used bits, which is the number of bits necessary to encode the audio data, is not larger than a maximum target bits. Thereafter, the conventional audio data encoding apparatus adjusts the scale factor value of audio data for each frequency band as the value used to quantize the audio data, thereby ensuring that a permissible distortion level of the audio data for each frequency band is not larger than a maximum permissible distortion level of the audio data for each frequency band. It is described above that the maximum permissible distortion level of the audio data for each frequency band can be different from each other. Thereafter, the conventional audio data encoding apparatus quantizes the audio data according to the scale factor value of the audio data for each frequency band. As a result, the bit rate of the audio data that is encoded according to the conventional audio data encoding apparatus can exceed the predetermined target bit rate.

On the other hand, the audio data encoding method and apparatus according to the present invention determine a scale factor value of audio data for each frequency band as a value used to quantize the audio data ensuring that a permissible distortion level of the audio data for each frequency band is not larger than a maximum permissible distortion level of the audio data for each frequency band. Thereafter, the audio data encoding method and apparatus according to the present invention adjusts the scale factor value of audio data for each frequency band as the value used to quantize the audio data ensuring that a used bits, which is the number of bits necessary to encode the audio data, is not larger than a maximum target bits. Thereafter, the audio data encoding method and apparatus according to the present invention quantizes the audio data according to the scale factor value of the audio data for each frequency band. As a result, the bit rate of the audio data that is encoded according to the present invention can not exceed the predetermined target bit rate in any case.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An audio data encoding method comprising:

determining an initial scale factor value for each frequency band of the audio data according to a quantization error and a maximum permissible distortion level for each frequency band;

comparing the initial scale factor value for each frequency band and a predetermined common scale factor value and determining a final scale factor value for each frequency band based on a comparison result;

quantizing the audio data using the final scale factor value for each frequency band; and encoding the quantized audio data.

2. The audio data encoding method of claim 1, wherein the determining of the initial scale factor value for each frequency band of the audio data comprises:

determining a maximum scale factor value from among scale factor values for each frequency band of the audio data satisfying a requirement that the quantization error does not exceed the maximum permissible distortion level as the initial scale factor value.

3. The audio data encoding method of claim 1, wherein the determining of the initial scale factor value for each frequency band of the audio data comprises:

adjusting a default scale factor value for each frequency band considering the quantization error according to the default scale factor and the maximum permissible distortion level, and determining the adjusted default scale factor value as the initial scale factor value.

4. The audio data encoding method of claim 1, wherein the determining the final scale factor value comprises:

determining value that is not larger between the initial scale factor value and the predetermined common scale factor value as the final scale factor value.

5. The audio data encoding method of claim 1, further comprising:

calculating a used bits of the audio data, which is the number of bits necessary to encode the audio data;

determining whether the used bits is larger than a predetermined maximum target bits; and if it is determined that the used bits is larger than the predetermined maximum target bits, updating the predetermined common scale factor value and proceeding to the comparing the initial scale factor value and the predetermined common scale factor value.

6. The audio data encoding method of claim 5, wherein the used bits is initially calculated after the final scale factor value is initially determined.

7. A non-transitory computer readable recording medium storing a program for executing a method of any one of claims 1 through 6.

8. The audio data encoding method of claim 1, wherein the permissible distortion level is determined using a psychoacoustic model.

9. An audio data encoding apparatus comprising:

a first scale factor determiner determining an initial scale factor value for each frequency band of the audio data according to a quantization error and a maximum permissible distortion level for each frequency band;

a second scale factor determiner comparing the initial scale factor value for each frequency band and a predetermined common scale factor value and determining a final scale factor value for each frequency band based on a comparison result;

a quantizer quantizing the audio data using the final scale factor value for each frequency band; and a lossless encoding unit encoding the quantized audio data.

10. The audio data encoding apparatus of claim 9, wherein the first scale factor determiner determines a maximum scale factor value from among scale factor values for each frequency bands of the audio data satisfying a requirement that the quantization error does not exceed the maximum permissible distortion level as the initial scale factor.

11. The audio data encoding apparatus of claim 9, wherein the first scale factor determiner adjusts a default scale factor value for each frequency band considering the quantization error according to the default scale factor and the maximum permissible distortion level, and determines the adjusted default scale factor value as the initial scale factor value.

12. The audio data encoding apparatus of claim 9, wherein the second scale factor determiner determines a value that is not larger between the initial scale factor value and the predetermined common scale factor value as the final scale factor value.

13. The audio data encoding apparatus of claim 9, further comprising:

a used bits calculator calculating a used bits of the audio data, which is the number of bits necessary to encode the audio data;

a bits comparator determining whether the used bits is larger than a predetermined maximum target bits; and a scale factor updater selectively updating the predetermined common scale factor value and selectively generating a control signal, based on a result determined by the bits comparator, wherein the second scale factor determiner operates in response to the control signal.

14. The audio data encoding apparatus of claim 13, wherein the used bits is initially calculated after the final scale factor value is initially determined.

15. The audio data encoding apparatus of claim 13, further comprising a psychoacoustic modeling unit to determine the permissible distortion level using a psychoacoustic model.

16. An audio data encoding apparatus to encode audio data having a plurality of frequency bands, the encoding apparatus comprising:

a psychoacoustic modeling unit to determine a permissible distortion level for each frequency band of the audio data using a psychoacoustic model;

a first scale factor determiner to determine an initial scale factor value for each frequency band of the audio data according to the maximum permissible distortion level for each frequency band determined by the psychoacoustic modeling unit;

a second scale factor determiner to compare the initial scale factor value determined for each frequency band and a predetermined common scale factor value and to determine a final scale factor value for each frequency band based on whichever scale factor value is determined to be less; and a quantizer to quantize the audio data using the final scale factor value for each frequency band.

* * * * *